United States Patent [19]

Zimmerle et al.

[11] 4,126,094

[45] Nov. 21, 1978

[54] COMBINATION HATCH COVER HAVING SUPPLEMENTAL LOCKING ARRANGEMENT

[75] Inventors: James R. Zimmerle, O'Fallon; Robert W. Randolph; Dallas W. Rollins, both of St. Charles, all of Mo.

[73] Assignee: ACF Industries, Incorporated, New York, N.Y.

[21] Appl. No.: 805,719

[22] Filed: Jun. 13, 1977

[51] Int. Cl.[2] ..... B61D 39/00

[52] U.S. Cl. ..... 105/377; 49/193; 292/113; 292/250

[58] Field of Search ..... 105/377, 308, 310; 114/201 R; 49/169, 171, 193; 292/113, 114, 247, 250

[56] References Cited

U.S. PATENT DOCUMENTS

| | | | |
|---|---|---|---|
| 900,672 | 10/1908 | Egan | 292/113 |
| 1,005,825 | 10/1911 | Gillett et al. | 49/169 |
| 1,790,307 | 1/1931 | Kadel | 105/308 R |
| 2,547,859 | 4/1951 | Duffie et al. | 105/377 |
| 2,835,211 | 5/1958 | Abel | 105/377 |
| 4,040,363 | 8/1977 | Walk et al. | 105/377 |

FOREIGN PATENT DOCUMENTS

| | | | |
|---|---|---|---|
| 946,005 | 5/1949 | France | 49/193 |
| 906,132 | 9/1962 | United Kingdom | 292/247 |

*Primary Examiner*—Albert J. Makay
*Assistant Examiner*—Carl Rowold
*Attorney, Agent, or Firm*—Henry W. Cummings

[57] ABSTRACT

In a combination hatch cover for railway car roofs,including a large cover having a smaller cover mounted thereon, each having their own separately operable latch, a supplemental locking arrangement is provided to maintain the small cover in closed position when the latch cover is moved to open position resting on the car roof.

7 Claims, 6 Drawing Figures

COMBINATION HATCH COVER HAVING SUPPLEMENTAL LOCKING ARRANGEMENT

BACKGROUND OF THE INVENTION

This invention relates to combination hatch covers for railway cars.

In U.S. Pat. No. 4,040,363 assigned to the same assignee as the present application, and hereby incorporated into the present application by this reference, a combination hatch cover is provided in a railway car roof in which a large hatch cover extends longitudinally of the longitudinal axis of the car. A small cover is mounted upon the large cover. The large cover has its own separately operable latch and is movable relative to the roof between open and closed positions. The small cover has its own separately operable latch, whereby the small cover can be opened and closed independently of the large cover. In one embodiment in U.S. Pat. No. 4,040,363 the small cover latch is located on the same side of the large cover and the large cover latch.

The latch for the small cover in the above mentioned patent application, includes an overcenter locking arrangement having an outwardly extending locking handle adapted to be stepped on by the operator to hold the small cover in closed position. However, it has been found that when the large cover is moved from closed to open position and is pivoted 180° about its hinge, the impact which occurs when the larger cover strikes the roof jars the small cover and the small cover latch is moved from its overcenter position to an open position. Having the small cover in open position when the large cover is also in open position is awkward for the operator on the car roof, and presents a safety hazard.

SUMMARY OF THE INVENTION

It is the object of the present invention to provide an arrangement to maintain the small cover latch means in closed position when the large cover is pivoted into the open position.

The latch mechanism for the small cover includes a ring which engages an outwardly extending hook on the small cover. A locking handle is pivotably mounted about a horizontally extending pin. The ring passes through the handle. The handle is contoured such that the operator can apply pressure to the handle, preferably with his foot, to move the handle into an overcenter position engaging a locking plate mounted on the large cover.

To maintain the small cover locking handle in the closed position when the large cover is pivoted to the open position, a supplemental locking plate is pivotably mounted adjacent the small cover latch means, such that in an operative position the supplemental locking plate extends over the existing locking handle. The supplemental locking plate is pivotably mounted about a suitable fastener which is tightened down with sufficient torque to maintain the locking handle in closed position even when in the open position the large cover impacts the roof and tends to jar the small cover latch from the closed position. The locking plate may also be moved to an inoperative position in which the small cover locking handle may be moved from the closed to the open position to open the small cover. A projection may be provided on the locking plate to assist the operator in moving the supplemental locking plate between operative and inoperative positions. Preferably the latch means for the small cover is mounted on the same side of the large cover as the large cover hinge means. Thus the small cover latch means does not travel as far, and less momentum is developed prior to impact of the large cover with the walkway.

THE DRAWINGS

DESCRIPTION OF PREFERRED EMBODIMENT

Figure 1:
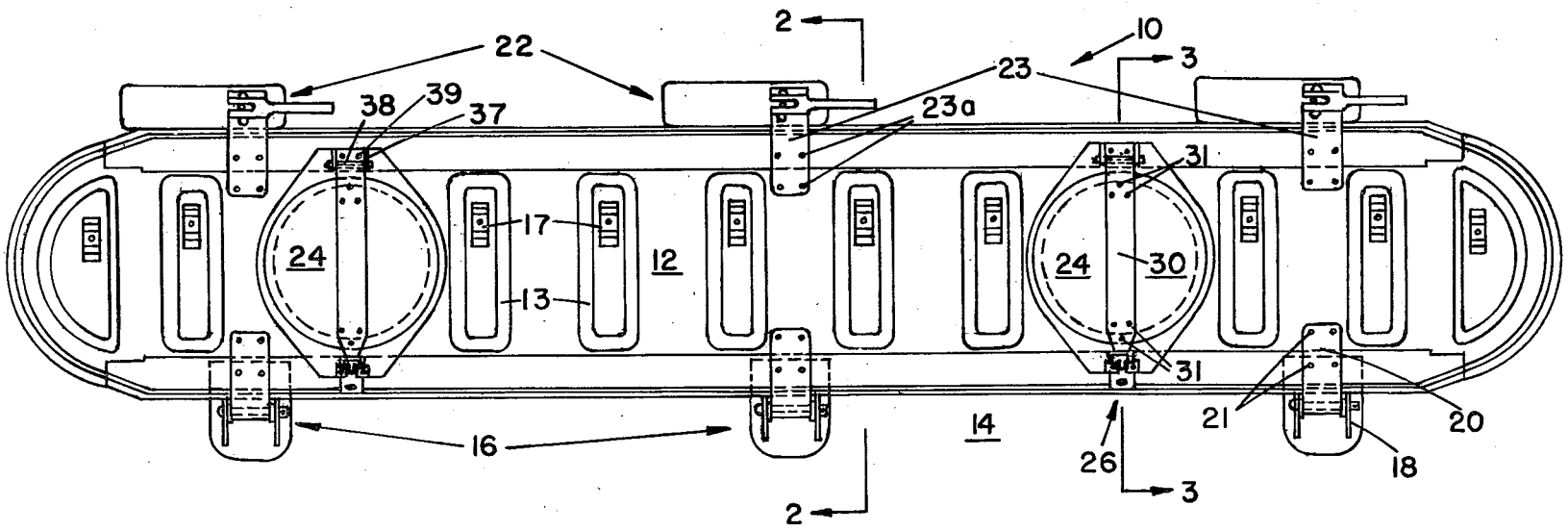
FIG. 1 is a plan view of a combination hatch cover with which the supplemental locking arrangement of the present invention may be used.

In FIG. 1 a combination hatch cover for railway cars is indicated generally at 10. The cover illustrated is made of fiberglass, although other hatch cover materials such as aluminum alloy or steel may be used. This cover comprises a large cover 12 which is pivotably mounted upon a car roof 14 by means of hinge means 16. A seal **12*a* (FIG. 3) attached to the large cover engages roof coming 14*a*. Hinge means 16 comprises a bracket 18 mounted on the roof 14, housing a pin 19 about which a plate 20 is pivotally mounted which is attached to the large cover with fasteners 21. Also mounted on the car roof are large cover latch means 22 which engage plates 23 mounted on the opposite side of the large cover with fasteners 23*a*. The large cover latch 22 is of conventional design and U.S. Pat. Nos. 4,040,363, 3,307,498 and 3,250,233, all hereby incorporated into the present application by this reference, may be relied on as disclosing suitable latching arrangements for the large cover. The latch illustrated is that disclosed in U.S. Pat. No. 3,307,498. The large cover includes reinforcements 13 and strikers 17**.

A plurality of small covers 24 are mounted upon large cover 12. Each small cover 24 includes a hinge indicated at 26 and a seal **24*a* which engages an outwardly extending flange 12*b*** of the large cover (FIG. 3).

Figure 2:
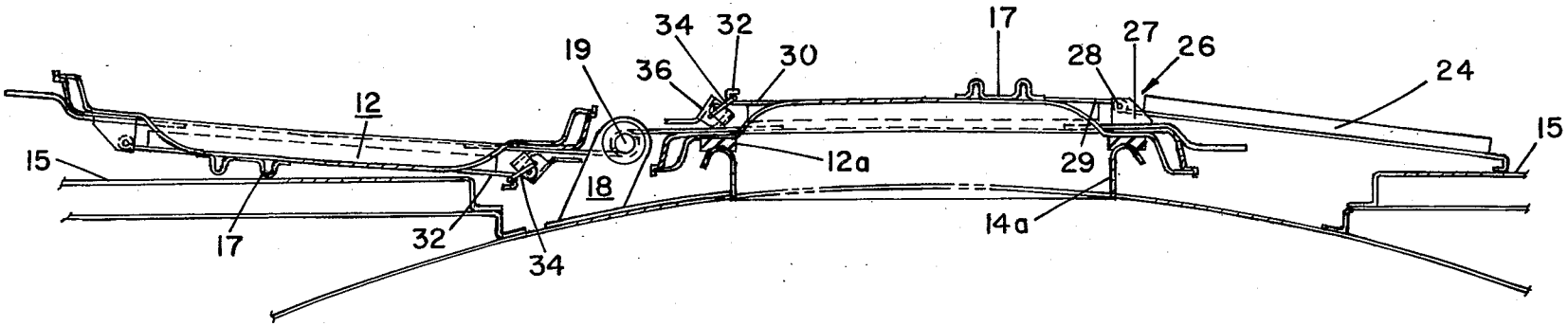
FIG. 2 is a sectional view looking in the direction of the arrows along the line 2—2 in FIG. 1 illustrating the large cover and the small cover respectively in open position.
Figure 3:
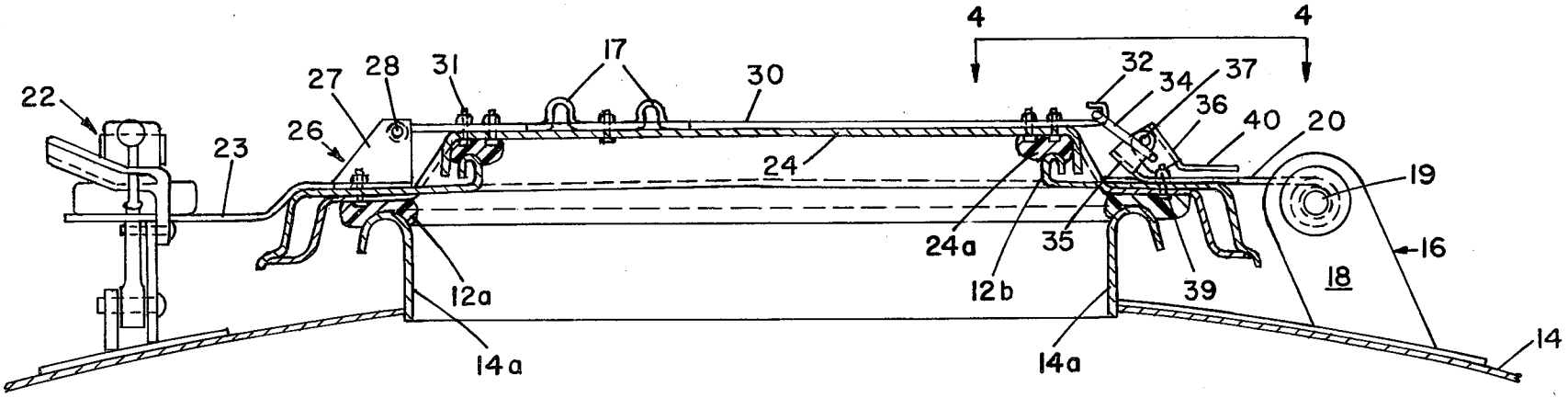
FIG. 3 is a sectional view looking in the direction of the arrows along the line 3—3 in FIG. 1.

As shown in FIGS. 2 and 3, the small cover hinge 26 includes a bracket 27 mounted on large cover 12 having a pin 28 about which a hinge mounting plate 30 is pivotally mounted. The righthand portion of FIG. 2 shows a small cover 24 in open position engaging the walkway or running board 15.

A strap 30 is attached to cover 24 with Huck bolt fasteners 31. Strap 30 includes a hook portion 32 adapted to be engaged by a ring 34. Ring 34 extends within an overcenter locking member 36 which is pivotably mounted on a bracket 35 by means of a pin 37. The bracket 35 is attached to a plate 38 which is attached to the large cover 12 with fasteners 39. The operator can step on the extension 40 of overcenter locking member 36 to move it into an overcenter position engaging plate 38.

Previously when the large cover 12 was moved to the open position (lefthand side of FIG. 2) and was dropped against the walkway 15, in some instances the impact forced the locking member 36 from the overcenter position to an open position, which would allow the small cover to open.

To cure this problem latch means 32 are located on the same side of the large cover as large cover hinge means 16. Thus the small cover latch means does not travel as far when the large cover is moved to open position and less impact momentum is developed. It will be noted that the small cover latch means 32 are rotated 180° from that shown in U.S. Pat. No. 4,040,363 (FIG. 7). Thus small cover latch means 32 does not travel as far as in U.S. Ser. No. 694,000 and does not develop as much momentum prior to impact of the large cover with the walkway.

Figure 4:
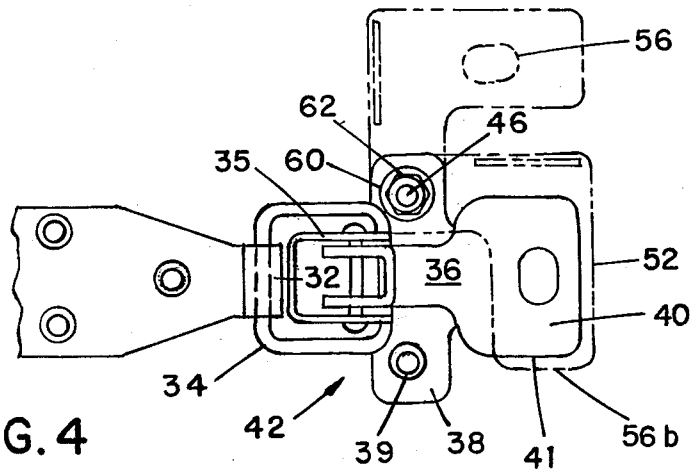
FIG. 4 is an enlarged plan view looking in the direction of the arrows along the line 4—4 in FIG. 3 illustrating the supplemental locking arrangement of the present invention.
Figures 5, 6:
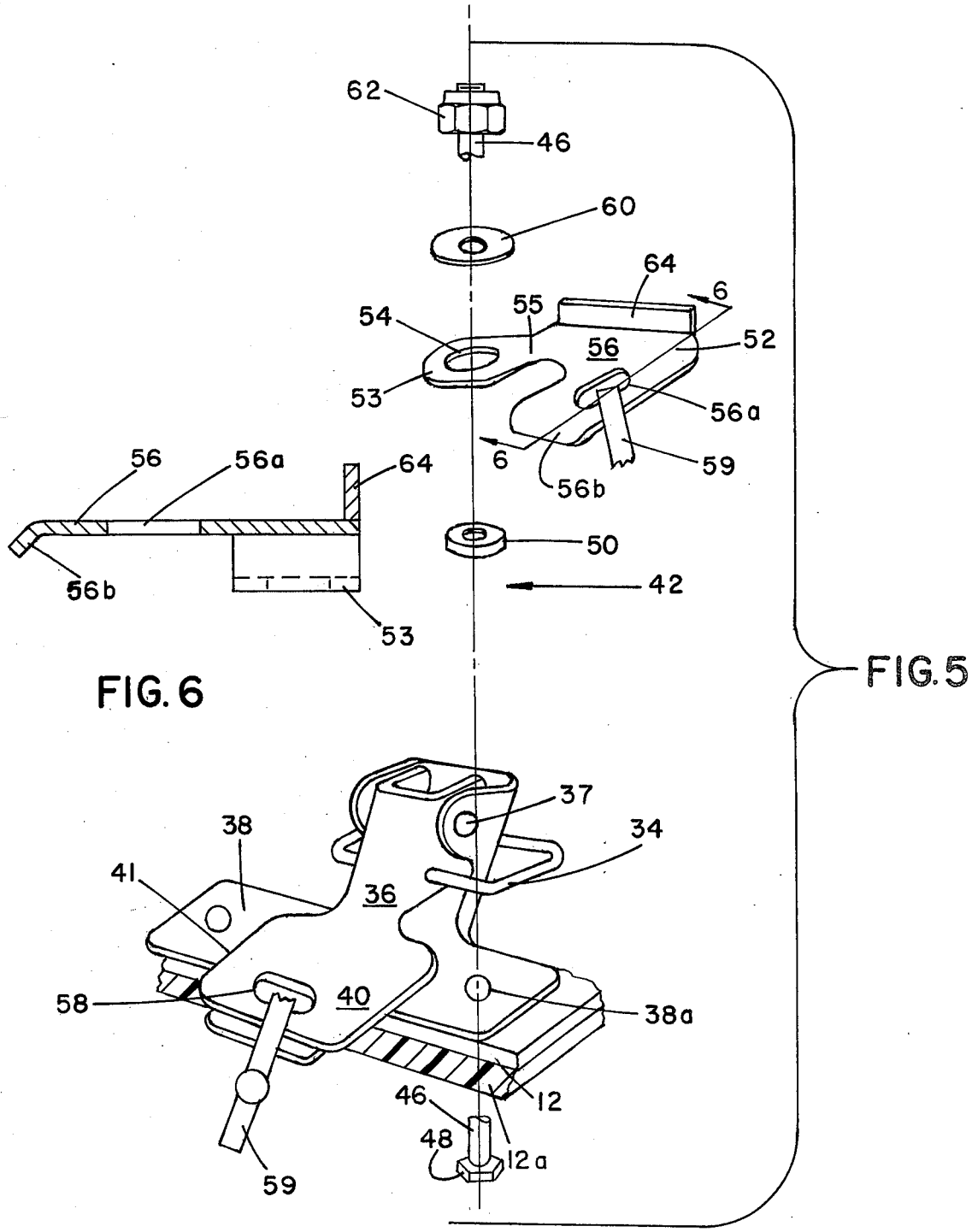
FIG. 5 is an exploded perspective view illustrating the component parts of the supplemental locking arrangement of the present invention.
FIG. 6 is a sectional view looking in the direction of the arrows along the line 6—6 in FIG. 5 illustrating the locking lip on the supplemental lock.

Furthermore, as shown in FIGS. 4 and 5, a supplemental latching arrangement 42 is provided which includes a stud 46 which replaces one of the fasteners 39. The stud includes a head 48 located below larger cover 12. Stud 46 extends upwardly through large cover 12 and also through an opening 38*a* in plate 38. A spacer 50 is then provided, and a supplemental locking plate 52 is mounted on stud 46 above spacer 50.

Locking plate 52 is provided with base portion 53 having first opening 54 through which stud 46 passes. An inclined portion 55 joins base portion 53 with an upper, flat portion 56 having a second opening 56*a*. Flat portion 56 includes a lip 56*b*. Locking plate 52 is movable between an inoperative position (shown in phantom in FIG. 4) allowing the small cover to be moved between open and closed position as described in U.S. Pat. No. 4,040,363, and an operative position (also shown in phantom in FIG. 4). In moving to the operative position, lip 56 slidingly engages extension 40 and then drops over the opposite side 41 of extension 40. In the operative position overlying handle extension 40, handle 36 is prevented from moving from the overcenter closed position and cover 24 is maintained in the closed position.

A retainer washer 60 and a fastening nut 62 maintain locking plate 52 in place. A vertical projection 64 may be provided on locking plate 52 to assist the operator in moving the locking plate between open and closed positions. Vertical projection 64 is conveniently welded to the upper surface of locking plate 52 or may be formed integrally therewith.

In operation when the car arrives for unloading, the large cover and small cover will be in the closed and latched position. To open the small cover the railroad seal 59 is first removed from openings 56*a* and 58. The operator then moves the locking plate 52 to the inoperative position uncovering locking handle 36 and extension 40. The operator may do this, for example, with his foot or with a suitable tool which engages vertical projection 64. Lip 56*b* slidingly engages extension 40 during this counter clockwise movement in FIG. 4. The operator then moves latch handle 36 upwardly out of the overcenter position which moves ring 34 out of engagement with hook 32 on strap 30. The small cover may then be opened by pivoting the cover about the hinge 26 to the position shown in the right-hand portion of FIG. 2. The small cover may be closed by carrying out the process in reverse, the lip 56*b* slidingly engaging the extension 40, and then dropping over the side 41. Locking plate 52 thus remains over locking handle 36 to prevent its inadvertent opening during opening of the large cover 12 when it impacts walkway 15.

The large cover is opened by opening latch means 22, in the manner described in U.S. Pat. Nos. 3,307,498 (or 3,250,233 if this latch is used) and then pivoting the large cover about hinge 16. If the large cover is moved to the full open position as shown in FIG. 2, the supplemental locking plate 52 will maintain locking plate 36 in the closed position, not withstanding the fact that the large cover may be dropped on the walkway 15 and that previously the locking handle 36 would have moved from the closed, overcenter position to the open position allowing the small cover to open.

What is claimed is:

1. A combination hatch cover for use in railway car roofs in which a large cover is hingedly mounted on the roof and wherein the large cover has latch means mounted on the roof for maintaining the large cover in closed position, and wherein a small cover is mounted on the large cover and wherein small cover hinge means mount the small cover on the large cover and wherein separate small cover latch means tend to maintain said small cover in the closed position, said small cover latch means including a latch on said small cover, and an overcenter locking handle pivotably mounted on the large cover, said handle engaging said latch in closed position, said locking handle tending to maintain said small cover in closed position; said large cover when moved to open position impacting said roof and applying an impact force to said small cover; said small cover latch means being mounted on the same side of the large cover as said large cover hinge means to reduce the tendency of said impact force to cause said small cover latch means to open; a supplemental locking assembly mounted on said large cover adjacent said small cover latch means; said supplemental locking assembly including a supplemental locking plate pivotably mounted as to be movable between an operative position overlying said overcenter locking handle to prevent said latch from disengaging when said large cover is opened and impacts against the car roof structure, and an inoperative position wherein said supplemental locking plate does not overlie said overcenter locking handle and in which inoperative position said overcenter locking handle may be moved from a closed, overcenter position to an open position, allowing disengagement of said latch with said handle to open said small cover.

2. An improved combination hatch cover according to claim 1 wherein said supplemental locking plate includes a lip which in operative position engages a side of said locking handle.

3. An improved combination hatch cover according to claim 2 wherein said supplemental locking plate slidingly engages said locking handle in moving between operative and inoperative positions.

4. An improved combination hatch cover according to claim 3 wherein said supplemental locking plate includes a base portion having means for pivoting said supplemental locking plate about a vertical axis and an upper flat portion including said lip.

5. An improved combination hatch cover according to claim 4 wherein said overcenter locking handle is pivotably mounted upon a bracket which is integral with a latch plate mounted on said large cover and wherein said fastening means includes a stud extending through said large cover and said latch plate.

6. A combination hatch cover for use in railway car roofs in which a large cover is hingedly mounted on the roof and wherein the large cover has latch means mounted on the roof for maintaining the large cover in closed position, and wherein a small cover is mounted on the large cover and wherein small cover hinge means mount the small cover on the large cover and wherein separate small cover latch means tend to maintain said small cover in the closed position, said small cover latch means including a latch on said small cover, and an overcenter locking handle pivotably mounted on the large cover, said handle engaging said latch in closed position; said large cover when moved to open position impacting said roof and applying an impact force to said small cover; said small cover latch means being mounted on the same side of the large cover as said large cover hinge means to reduce the tendency of said impact force to cause said small cover latch means to open; a supplemental locking assembly mounted on said large cover adjacent said small cover latch means; said supplemental locking assembly including a supplemental locking plate pivotably mounted as to be movable between an operative position overlying said overcenter locking handle to prevent said latch from disengaging when said large cover is opened and impacts against the car roof structure, and an inoperative position wherein said supplemental locking plate does not overlie said overcenter locking handle and in which inoperative position said overcenter locking handle may be moved from a closed, overcenter position to an open position, allowing disengagement of said latch with said handle to open said small cover; said supplemental locking plate including a base portion having means for pivoting said supplemental locking plate about a vertical axis and an upper flat portion including a lip which, in engaged position, engages a side of said locking handle.

7. An improved combination hatch cover according to claim 6 wherein said supplemental locking plate slidingly engages said locking handle in moving between operative and inoperative positions.

* * * * *